US010619906B2

(12) United States Patent
Zhang et al.

(10) Patent No.: US 10,619,906 B2
(45) Date of Patent: Apr. 14, 2020

(54) BRANCHING AIR SUPPLY DEVICE AND REFRIGERATOR WITH BRANCHING AIR SUPPLY DEVICE

(71) Applicant: Qingdao Haier Joint Stock Co., Ltd., Qingdao (CN)

(72) Inventors: Kui Zhang, Qingdao (CN); Bin Fei, Qingdao (CN); Ming Wang, Qingdao (CN); Xueli Cheng, Qingdao (CN); Chunyang Li, Qingdao (CN)

(73) Assignee: QINGDAO HAIER JOINT STOCK CO., LTD, Qingdao (CN)

( * ) Notice: Subject to any disclaimer, the term of this patent is extended or adjusted under 35 U.S.C. 154(b) by 101 days.

(21) Appl. No.: 15/756,130

(22) PCT Filed: Jun. 8, 2016

(86) PCT No.: PCT/CN2016/085346
§ 371 (c)(1),
(2) Date: Feb. 28, 2018

(87) PCT Pub. No.: WO2017/036224
PCT Pub. Date: Mar. 9, 2017

(65) Prior Publication Data

US 2018/0245836 A1 Aug. 30, 2018

(30) Foreign Application Priority Data

Aug. 28, 2015 (CN) ..... 2015 1 0543634

(51) Int. Cl.
*A47J 47/00* (2006.01)
*F25D 17/04* (2006.01)
*F25D 11/02* (2006.01)

(52) U.S. Cl.
CPC ..... *F25D 17/045* (2013.01); *F25D 11/02* (2013.01)

(58) Field of Classification Search
CPC ..... F25D 17/045; F25D 11/02
(Continued)

(56) References Cited

U.S. PATENT DOCUMENTS 3,950,112 A * 4/1976 Crump ..... F04D 25/166 415/206
5,735,138 A 4/1998 Park et al.
(Continued)

FOREIGN PATENT DOCUMENTS

CN 1155062 A 7/1997
CN 1708664 A 12/2005
(Continued)

OTHER PUBLICATIONS

English translation of the Abstract of document FR2516213A1.*
(Continued)

*Primary Examiner* — Helena Kosanovic
(74) *Attorney, Agent, or Firm* — Alston & Bird LLP

(57) ABSTRACT

Provided are a branching air supply device and a refrigerator with same. The branching air supply device comprises: a housing, having a first half portion and a second half portion that are symmetric with respect to a geometric symmetrical plane, the first half portion and the second half portion each being provided with at least one air inlet and multiple air outlets; and a first adjusting piece and a second adjusting piece that are symmetrically arranged with respect to the geometric symmetrical plane, the first adjusting piece and the second adjusting piece being respectively configured to completely shield, partially shield, or completely expose each air outlet of the first adjusting piece and the second adjusting piece in a controlled mode, to adjust an air-outlet area of each air outlet. The branching air supply device is symmetrically disposed with the first half portion and the second half portion in a refrigerator.

11 Claims, 6 Drawing Sheets

(58) Field of Classification Search
USPC ..... 454/183, 184
See application file for complete search history.

(56) References Cited

U.S. PATENT DOCUMENTS

| | | | | |
|---|---|---|---|---|
| 5,992,165 | A | 11/1999 | Kim et al. | |
| 8,133,005 | B2 * | 3/2012 | Hsu | F04D 25/166 415/203 |
| 2007/0137243 | A1 | 6/2007 | Lee et al. | |
| 2010/0125365 | A1 * | 5/2010 | Ahn | F25D 17/065 700/275 |
| 2011/0100046 | A1 * | 5/2011 | Choi | F25D 17/065 62/320 |

FOREIGN PATENT DOCUMENTS

| | | | | |
|---|---|---|---|---|
| CN | 201251338 | Y | 6/2009 | |
| CN | 101975497 | A | 2/2011 | |
| CN | 102192630 | B | 9/2013 | |
| CN | 103900323 | A | 7/2014 | |
| CN | 204214187 | U | 3/2015 | |
| CN | 204404651 | U | 6/2015 | |
| CN | 205002482 | U | 1/2016 | |
| EP | 2789937 | A1 | 10/2014 | |
| FR | 2516213 | A1 * | 5/1983 | B60H 1/00471 |
| JP | H06180175 | A | 6/1994 | |
| KR | 101496679 | B1 | 3/2015 | |
| WO | WO 2009069900 | A2 | 6/2009 | |

OTHER PUBLICATIONS

International Search Report and Written Opinion of the International Searching Authority for International Patent Application No. PCT/CN2016/085346, dated Sep. 7, 2016, with English translation of the Search Report, 12 pages.
Office Action for Chinese Patent Application No. 201510543634.6 dated Aug. 21, 2017, with English translation, 10 pages.
Search Report for Chinese Patent Application No. 201510543634.6 dated Aug. 11, 2017, 2 pages.

* cited by examiner

BRANCHING AIR SUPPLY DEVICE AND REFRIGERATOR WITH BRANCHING AIR SUPPLY DEVICE

CROSS-REFERENCE TO RELATED APPLICATIONS

This application is a national phase entry of International Application No. PCT/CN2016/085346, filed Jun. 8, 2016, which claims priority to Chinese Application No. 201510543634.6, filed Aug. 28, 2015, the entire contents of which are incorporated herein by reference.

TECHNICAL FIELD

The present invention relates to a refrigerating device, and particularly to a branching air supply device and a refrigerator having the branching air supply device.

BACKGROUND OF THE INVENTION

In recent years, with the improvement of people's living standards and improvement of environmental awareness, the requirements for refrigerators have gradually changed from satisfaction with low-temperature refrigeration to the performance of keeping food fresh. Hence, air cooled refrigerators are increasingly favoured by people.

For an air cooled refrigerator, the performance of keeping food fresh largely depends on airflow circulation within storage compartments of the air cooled refrigerator and a temperature difference between different parts within the refrigerator. If the airflow circulation within the refrigerator is reasonable, the smaller the temperature difference is, the better the refrigerator's performance of keeping food fresh will be. Meanwhile, a key component to determine the reasonability of the airflow circulation within the refrigerator is an air duct which controls air directions and flow rate magnitudes within the refrigerator and directly determines the refrigeration and freshness preservation effects of the refrigerator.

Furthermore, in order to optimize storage spaces, a single storage compartment may generally be separated into a plurality of subdivided storage spaces by shelving devices such as shelves or drawers, and according to the amount of stored articles, the refrigerating capacity required for each of the storage spaces also varies. Therefore, cold air directly entering the storage compartment from a certain place of the storage compartment without control may cause the problem that some of the storage spaces are overcooled and some suffer from an insufficient refrigerating capacity.

In the air path design of current air cooled refrigerators on the market, some of the air cooled refrigerators adopt the method that air flows out of the freezing chamber and directly passes to the refrigerating chamber. In common air cooled refrigerators, there is no damper between the freezing chamber and the refrigerating chamber, various air paths on the air duct are connected in series, and when the temperature of the refrigerating chamber reaches a set temperature, cold air in the freezing chamber further continues to flow towards the refrigerating chamber, rendering the temperature in the refrigerating chamber always in a circularly fluctuating state, that is, the temperature within the refrigerating chamber is changing all the time, greatly affecting the freshness preservation performance of the refrigerator. For other air cooled refrigerators, an evaporator is arranged within an individual accommodation chamber, the accommodation chamber of the evaporator is communicated to each storage compartment with a complex air duct system, and cold air generated by the evaporator is transported to each storage compartment with a draught fan. A control device such as an electric damper is arranged within the air duct to control the opening and closing of the air duct communicated with each storage compartment or adjust the amount of air entering each storage compartment. However, this structure is relatively complex and is inconvenient to be controlled uniformly. In addition, cold air entering each storage compartment cannot be distributed and regulated according to the refrigerating capacity requirement for each storage space.

SUMMARY OF THE INVENTION

The purpose of a first aspect of the present invention is intended to overcome one defect of an existing air cooled refrigerator and provide a branching air supply device for a refrigerator, so as to facilitate the uniform adjusting of flow paths and flow rate of cold air and enable air to flow out of left and right sides of an air-outlet region on each layer in a storage compartment of the refrigerator and the refrigerating to be uniform.

The purpose of a second aspect of the present invention is to provide a refrigerator having the branching air supply device above.

According to the first aspect of the present invention, provided in the present invention is a branching air supply device, comprising:

a housing having a first half portion and a second half portion that are symmetric about a geometric symmetrical plane, the first half portion and the second half portion each being provided with at least one air inlet and a plurality of air outlets; and a first adjusting piece and a second adjusting piece symmetrically arranged with respect to the geometric symmetrical plane that are respectively configured to completely shield, partially shield or completely expose each of the air outlets of the first half portion and the second half portion in a controlled mode so as to adjust an air-outlet area of each of the air outlets.

Optionally, the first adjusting piece and the second adjusting piece synchronously move in opposite directions to completely shield, partially shield or completely expose the plurality of air outlets of the first half portion and the second half portion in a synchronous and symmetrical manner.

Optionally, the housing comprises a base;

the first half portion and the second half portion each comprise an arcuate peripheral wall extending from one surface of the base, and the plurality of air outlets are formed on the arcuate peripheral wall of each of the first half portion and the second half portion respectively;

the first adjusting piece and the second adjusting piece each comprise one or more shield portions spaced along a circumferential direction of the respective arcuate peripheral wall, and at least part of each of the shield portions of the first half portion and the second half portion oriented towards a surface of the respective arcuate peripheral wall is coaxially arranged with the arcuate peripheral wall, and the first adjusting piece and the second adjusting piece are rotatably mounted to the housing about an axis of the respective arcuate peripheral wall, so that the one or more shield portions of each of the first adjusting piece and the second adjusting piece completely shield, partially shield or completely expose each of the respective air outlets when being moved to a different position.

Optionally, the at least one air inlet of each of the first half portion and the second half portion is one air inlet, and two ends of the arcuate peripheral wall of each of the first half portion and the second half portion along the respective circumferential direction define a respective air inlet; or the first half portion and the second half portion each further comprise another arcuate peripheral wall extending from the one surface of the base, constituting a cylindrical structure with the arcuate peripheral wall, and the at least one air inlet is formed on the other arcuate peripheral wall of each of the first half portion and the second half portion respectively.

Optionally, the first adjusting piece and the second adjusting piece each further comprise a rotary table portion, and each of the shield portions of the first half portion and the second half portion extends from one surface of the respective rotary table portion respectively.

Optionally, the rotary table portions of the first adjusting piece and the second adjusting piece are rotatably mounted to an end face of the respective arcuate peripheral wall away from one end of the base.

Optionally, each of the shield portions of the first adjusting piece and the second adjusting piece is respectively located on a radial inner side of the respective arcuate peripheral wall.

Optionally, the branching air supply device further comprises: a motor arranged on a radial outer side of the rotary table portion of the first adjusting piece and/or the second adjusting piece; and a transmission mechanism configured to transfer the rotary motion output by the motor to the first adjusting piece and the second adjusting piece in a decelerating manner.

Optionally, the transmission mechanism comprises:

a first gear mounted to an output shaft of the motor; and two second gears engaged with each other that are coaxially fixed to another surface of the rotary table portions of the first adjusting piece and the second adjusting pieces respectively with the rotary table portions of the first adjusting piece and the second adjusting pieces, one of the second gears being engaged with the first gear.

Optionally, the housing further comprises:

one or more rib plates extending from the one surface of the base;

a distributor cover arranged on the end of the one or more rib plates away from the base; and the base, the one or more rib plates and the distributor cover define:

an air-inlet passage communicated with each of the air inlets and symmetrically arranged with respect to the geometric symmetrical plane;

a plurality of first air-outlet passages respectively communicated with the plurality of air outlets of the first half portion; and a plurality of second air-outlet passages respectively communicated with the plurality of air outlets of the second half portion, the plurality of second air-outlet passages and the plurality of first air-outlet passages being symmetrically arranged with respect to the geometric symmetrical plane.

According to the second aspect of the present invention, provided in the present invention is a refrigerator, having a storage compartment. Particularly, the refrigerator further comprises:

an air duct assembly which is symmetrically arranged with respect to a longitudinal symmetrical plane of the storage compartment and within which an air-inlet duct and a plurality of air-outlet ducts are defined, wherein each of the air-outlet ducts is provided with one or more cold air outlets, and the plurality of air-outlet ducts are configured such that air flow out of the air duct assembly enters the storage compartment from a plurality of positions being on compartment walls of the storage compartment and being symmetric about the longitudinal symmetrical plane, respectively; and the branching air supply device according to any one above arranged within the air duct assembly, at least one air inlet of each of the first half portion and the second half portion of the branching air supply device being communicated with the air inlet duct, the plurality of air outlets of the first half portion being respectively communicated with a plurality of the air-outlet ducts located on one side of the longitudinal symmetrical plane, and the plurality of the second half portion being respectively communicated with a plurality of the air-outlet ducts located on the other side of the longitudinal symmetrical plane.

Optionally, two of the air-outlet ducts adjacent to the longitudinal symmetrical plane are communicated with each other, forming an air-outlet duct space symmetric about the longitudinal symmetrical plane.

Since the branching air supply device and the refrigerator of the present invention comprise a first half portion and a second half portion and each of the half portions is provided with a plurality of air outlets, the plurality of air outlets can be shielded controllably through the motion of the first adjusting piece and the second adjusting piece, so as to select an air-outlet duct and adjust the air-outlet amount within each air-outlet duct, so that cold air may be distributed reasonably according to refrigerating capacity requirements for different storage compartments or refrigerating capacity requirements at different positions in one storage compartment to increase the freshness preservation performance and running efficiency of the refrigerator.

Further, since the first half portion and the second half portion in the branching air supply device and the refrigerator of the present invention are symmetrically arranged, the plurality of air outlets on the first half portion and the second half portion may enable air to flow out of the left and right sides of the air-outlet region on each layer in the storage compartment of the refrigerator, thereby ensuring uniform refrigerating of the space on each layer of the storage compartment.

According to the detailed description of specific embodiments of the present invention below in conjunction with the accompanying drawings, the above and other purposes, advantages and features will become more apparent for a person skilled in the art.

BRIEF DESCRIPTION OF THE DRAWINGS

Some of specific embodiments of the present invention will be described below in detail with reference to the accompanying drawings by way of example but not by way of limitation. The same reference signs indicate the same or similar components or parts in the accompanying drawings. It is understood by a person skilled in the art that the drawings are not drawn to scale necessarily. In the accompanying drawings.

DETAILED DESCRIPTION OF THE INVENTION

Figure 1:
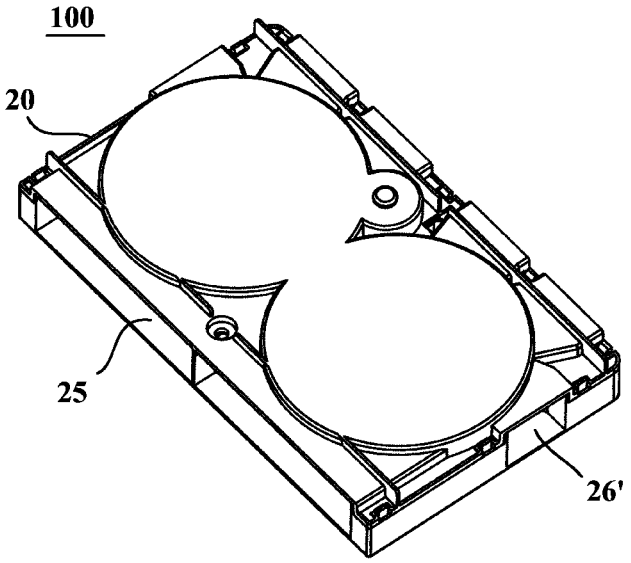
FIG. 1 is a schematic structural diagram of a branching air supply device according to one embodiment of the present invention.
Figure 2:
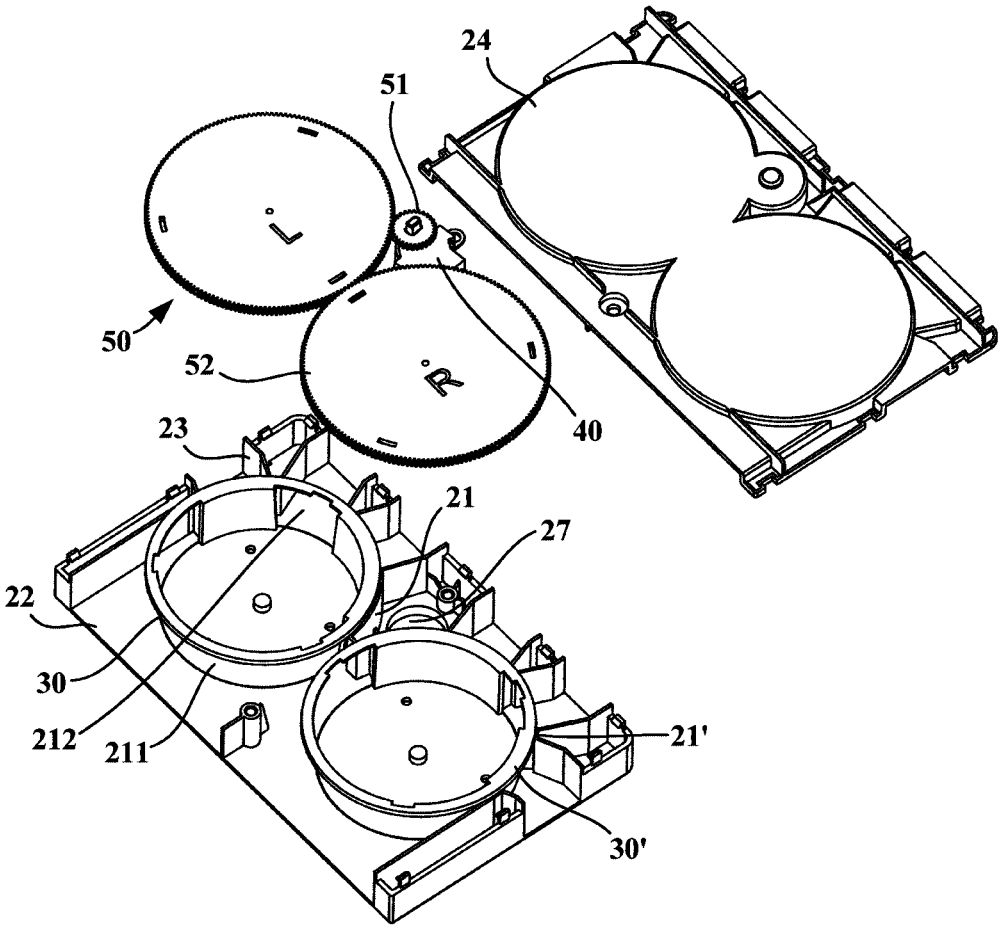
FIG. 2 is a schematic exploded view of the branching air supply device according to one embodiment of the present invention.

FIG. 1 is a schematic structural diagram of a branching air supply device 100 according to one embodiment of the present invention, and FIG. 2 is a schematic exploded view of the branching air supply device 100 according to one embodiment of the present invention. As shown in FIG. 1 and FIG. 2, embodiments of the present invention provide a branching air supply device 100 for a refrigerator. The branching air supply device 100 may comprise a housing 20, a first adjusting piece 30 and a second adjusting piece 30'. The housing 20 may have a first half portion 21 and a second half portion 21' that are symmetric about a geometric symmetrical plane. The first half portion 21 and the second half portion 21' each are provided with at least one air inlet 211 and a plurality of air outlets 212, so that air enters each of the half portions via the at least one air inlet 211 and flows out of each of the half portions from the plurality of air outlets 212.

The first adjusting piece 30 and the second adjusting piece 30' are symmetrically arranged with respect to the above-mentioned geometric symmetrical plane and are respectively configured to completely shield, partially shield or completely expose each of the air outlets 212 of the first half portion 21 and the second half portion 21' in a controlled mode to adjust an air-outlet area of each of the air outlets 212. For example, the first adjusting piece 30 and the second adjusting piece 30' may completely shield, partially shield or completely expose each of the air outlets 212 at a different position.

The first adjusting piece 30 and the second adjusting piece 30' of the branching air supply device 100 in the embodiments of the present invention can controllably distribute cold air flowing in from the air inlet 211 to the plurality of air outlets 212, so that control over the opening and closing of an air-outlet duct 320 (see FIG. 11) communicated with each of the air outlets 212 and/or adjustment of the air-outlet amount within each air-outlet duct 320 may be implemented, thus satisfying the refrigerating capacity demand of different storage compartments 200 (see FIG. 10) or the refrigerating capacity demand of one storage compartment 200 at different positions or the refrigerating capacity demand of different storage spaces within one storage compartment 200.

Particularly, since the first half portion 21 and the second half portion 21' are symmetrically arranged, a plurality of air-outlet ducts 320 respectively communicated with the first half portion 21 and the second half portion 21' may also be symmetrically arranged with respect to a longitudinal symmetrical plane of the refrigerator storage compartment 200, and in this way, during each adjustment, the air outlets 212 that may be used to supply air to a region on each layer of the refrigerator storage compartment 200 are simultaneously opened, closed or partially shielded, so that the amount of air entering the region on each layer of the refrigerator storage compartment 200 is consistent, and a space of each layer of the storage compartment 200 and the storage compartment are refrigerated uniformly. Specifically, the first adjusting piece 30 and the second adjusting piece 30' may synchronously move in opposite directions to completely shield, partially shield or completely expose the plurality of air outlets 212 of the first half portion 21 and the second half portion 21' in a synchronous and symmetrical manner.

In some embodiments of the present invention, as shown in FIG. 2, the housing 20 may comprise a base 22. The first half portion 21 and the second half portion 21' each may comprise an arcuate peripheral wall extending from one surface of the base 22 and the plurality of air outlets 212 are formed on the arcuate peripheral wall of each of the first half portion 21 and the second half portion 21' respectively. The arcuate peripheral wall may extend at a predetermined angle with respect to a surface of the base 22 and preferably extend perpendicularly to the surface of the base 22. The plurality of air outlets 212 may be formed on the arcuate peripheral wall along a circumferential direction of each of the arcuate peripheral walls in a spaced manner. In some embodiments, each of the arcuate peripheral walls may be a complete arcuate peripheral wall section, the plurality of air outlets 212 are formed on the complete arcuate peripheral wall section, and each of the air outlets 212 may be provided with an opening edge. In some other embodiments, the arcuate peripheral wall may comprise at least three arcuate peripheral wall section portions and the spacing between two of the arcuate peripheral wall section portions. Every two of the arcuate peripheral wall section portions are spaced by one air outlet 212. During processing, each of the arcuate peripheral wall section portions may be enabled to only extend from a plurality of positions of the base 22 to one side of the base 22.

In some embodiments of the present invention, the at least one air inlet 211 of each of the first half portion 21 and the second half portion 21' is one air inlet and two ends of the arcuate peripheral wall of each of the first half portion 21 and the second half portion 21' along the respective circumferential direction define a respective air inlet 211. In some alternative embodiments of the present invention, the first half portion 21 and the second half portion 21' each further comprise another arcuate peripheral wall extending from the one surface of the base 22, constituting a cylindrical structure with the arcuate peripheral wall, and the at least one air inlet 211 is formed on the other arcuate peripheral wall of each of the first half portion 21 and the second half portion 21' respectively.

In embodiments of the present invention, the first adjusting piece 30 and the second adjusting piece 30' each comprise one or more shield portions 31 spaced along the circumferential direction of the respective arcuate peripheral wall, and at least part of each of the shield portions 31 of the first half portion 21 and the second half portion 21' oriented towards the surface of the respective arcuate peripheral wall is coaxially arranged with the arcuate peripheral wall. In addition, the first adjusting piece 30 and the second adjusting piece 30' are rotatably mounted to the housing 20 about an axis of the respective arcuate peripheral wall, so that the one or more shield portions 31 of each of the first adjusting piece and the second adjusting piece completely shield, partially shield or completely expose each of the respective air outlets 212 when being moved to a different position.

Specifically, each of the shield portions 31 may be an arcuate shield plate to shield or expose each of the air outlets 212. Each of the shield portions 31 of the first adjusting piece 30 and the second adjusting piece 30' is respectively located on a radial inner side of the respective arcuate peripheral wall and also may be located on a radial outer side of the respective arcuate peripheral wall. For example, in the case where each of the shield portions 31 of the first adjusting piece 30 and the second adjusting piece 30' is respectively located on the radial inner side of the respective arcuate peripheral wall and when the first adjusting piece 30 and the second adjusting piece 30' rotate about the axis of the respective arcuate peripheral wall, in some embodiments, an outer side surface of the arcuate shield plate may be attached to an inner side surface of a corresponding arcuate peripheral wall in a sealed manner all the time, so that the arcuate shield plate can open or close one or more corresponding air outlets 212 at different rotary positions in a controlled mode. In some other embodiments, there is predetermined spacing between each of the shield portions and a corresponding arcuate peripheral wall, a sealing gasket 33 may be mounted at each of two ends of an arcuate outer surface of each of the shield portions in its rotary direction so as to facilitate the rotation of the shield portion and at least partially block the flowing of air to each of the air outlets 212 via a gap between the outer surface of each of the shield portions and the inner surface of the corresponding arcuate peripheral wall.

In some embodiments of the present invention, the first adjusting piece 30 and the second adjusting piece 30' each may further comprise a rotary table portion 32, and each of the shield portions 31 of the first half portion 21 and the second half portion 21' extends from one surface of the respective rotary table 32 respectively. The rotary table 32 may be disc-shaped or ring-shaped, and a full-circumference structure may enable the motion of the first adjusting piece 30 and the second adjusting piece 30' to be more stable. Specifically, in some embodiments, the rotary table portion 32 of each of the first adjusting piece 30 and the second adjusting piece 30' is rotatably mounted to an end face of the respective arcuate peripheral wall away from one end of the base 22. Each of the shield portions 31 is mounted on the radial inner side of the corresponding arcuate peripheral wall, and an end face of the shield portion 31 away from one end of a corresponding rotary table portion 32 may be in contact with and abut against the base 22.

In some embodiments of the present invention, the branching air supply device 100 may further comprise a motor 40 and a transmission mechanism 50. The motor 40 is arranged on a radial outer side of the rotary table portion 32 of the first adjusting piece 30 and/or the second adjusting piece 30'. The transmission mechanism 50 may be configured to transfer the rotary motion output by the motor 40 to the first adjusting piece 30 and the second adjusting piece 30' in a decelerating manner. During designing, the inventor finds that the rotation of the first adjusting piece 30 and the second adjusting piece 30' is not stable enough with the reason lying in the shaking of the motor 40, and therefore the inventor proposes to use the transmission mechanism 50 to weaken the effect of shaking of an output shaft of the motor 40, so as to enable the first adjusting piece 30 and the second adjusting piece 30' to rotate in place accurately. A decelerating and torsion-increasing function of the transmission mechanism 50 also may eliminate the jamming and stalling phenomenon of the motor 40. The special position where the motor 40 is arranged (namely, on the radial outer side of the rotary table portion 32 of the first adjusting piece 30 and/or the second adjusting piece 30') may enable the overall thickness of the branching air supply device 100 to be reduced, so that the space is saved and the branching air supply device is particularly used for a refrigerator.

The transmission mechanism 50 is preferably a gear transmission mechanism. Specifically, the transmission mechanism 50 may comprise a first gear 51 and two second gears 52 engaged with each other. The first gear 51 is mounted to the output shaft of the motor 40. The two second gears 52 engaged with each other are coaxially fixed to another surface of the rotary table portions 32 of the first adjusting piece 30 and the second adjusting pieces 30' respectively with the rotary table portions 32 of the first adjusting piece 30 and the second adjusting piece 30'. In addition, one of the second gears 52 is engaged with the first gear 51. Using the two second gears 52 engaged with each other, the synchronous motion of the first adjusting piece 30 and the second adjusting piece 30' in opposite directions may be well implemented, thereby ensuring the accuracy of adjustment.

Further, when the rotary table portion 32 of each of the first adjusting piece 30 and the second adjusting piece 30' is rotatably mounted to the end face of the respective arcuate peripheral wall away from the one end of the base 22 and the rotary table portion 32 is ring-shaped, the two second gears 52 may play a role of sealing an end opening of each of the arcuate peripheral walls away from the one end of the base 22. Of course, the rotary table portion 32 is used for sealing the end opening of each of the arcuate peripheral walls away from one end of the base 22 if the rotary table portion is circularly plate-shaped.

Specifically, in some embodiments of the present invention, each of the first half portion 21 and the second half portion 21' is provided with three air outlets 212, respectively being a first air outlet 213, a second air outlet 214 and a third air outlet 215 that are successively spaced along respective circumferential directions. The first air outlet 213, the second air outlet 214 and the third air outlet 215 of the first half portion 21 may be successively spaced along their circumferential directions and along an anticlockwise direction. The first air outlet 213, the second air outlet 214 and the third air outlet 215 of the second half portion 21' may be successively spaced along their circumferential directions and along a clockwise direction. Each of the first adjusting piece 30 and the second adjusting piece 30' is provided with two shield portions 31, respectively being a first shield portion 311 and a second shield portion 312. The first shield portion 311 and the second shield portion 312 of the first adjusting piece 30 may be successively spaced along the clockwise direction; and the first shield portion 311 and the second shield portion 312 of the second adjusting piece 30' may be successively spaced along the anticlockwise direction. The first shield portion 311 may be configured to allow it to completely shield one air outlet 212. The second shield portion 312 may be configured to allow it to completely shield two air outlets 212. The spacing between the first shield portion 311 and the second shield portion 312 may be configured to allow it to completely expose one air outlet 212.

Figure 3:
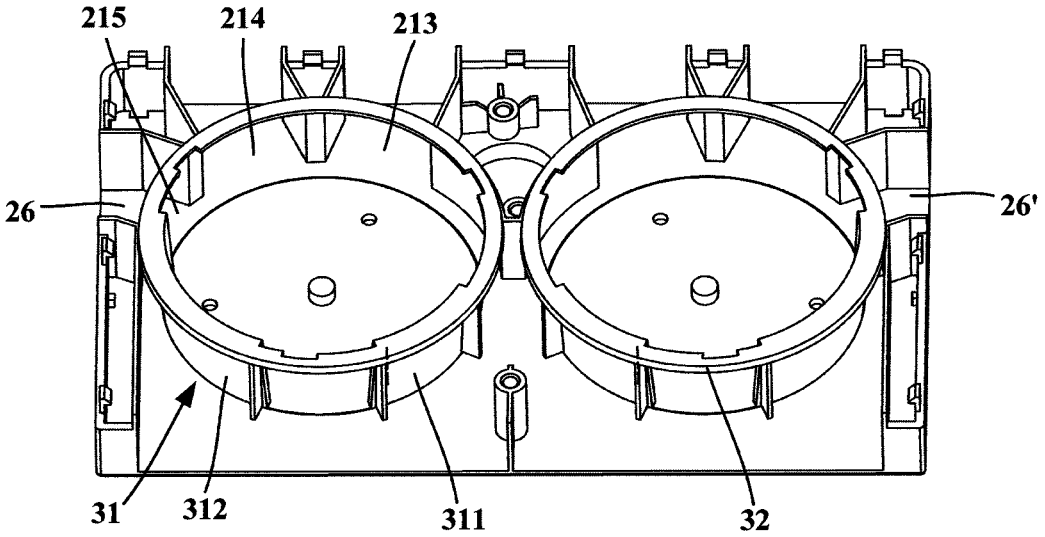
FIGS. 3-9 respectively show schematic partial structural diagrams of a first adjusting piece and a second adjusting piece in the branching air supply device at different rotary positions according to embodiments of the present invention.
Figure 4:
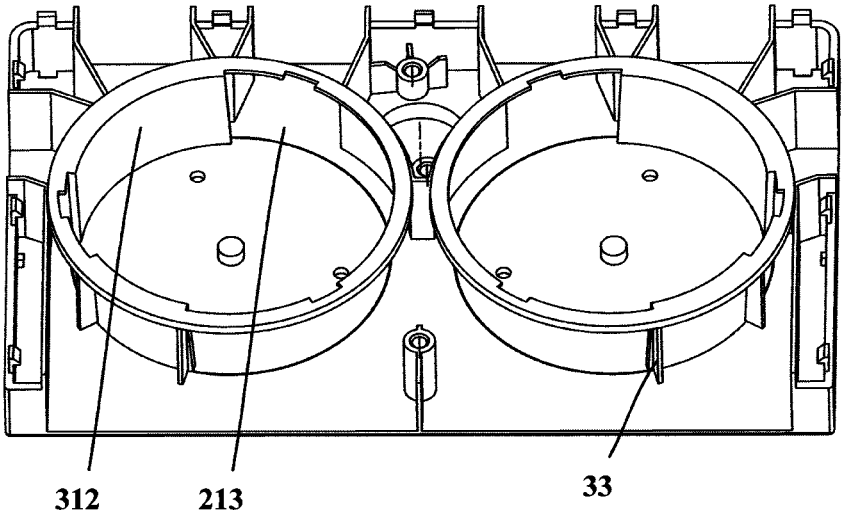
Figure 5:
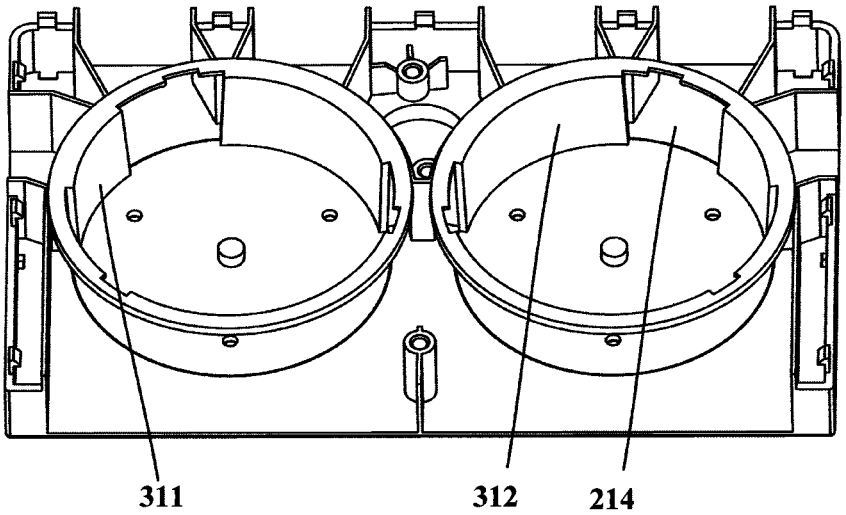
Figure 6:
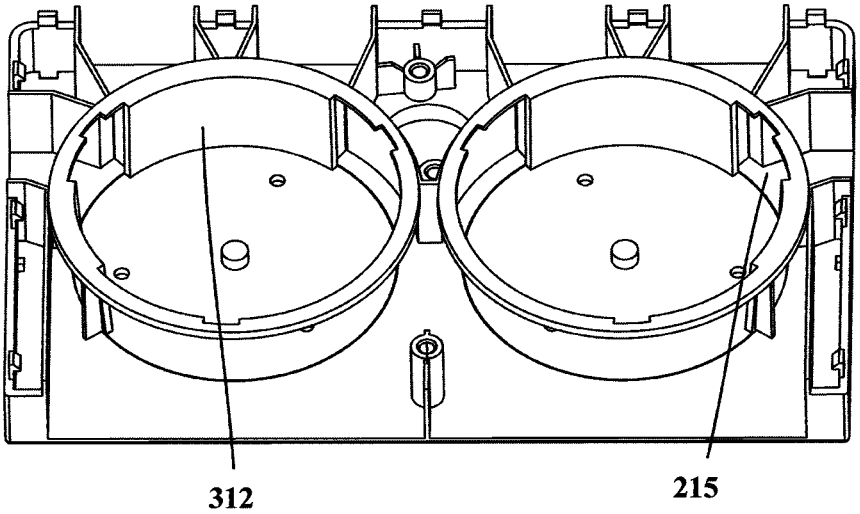

FIGS. 3-9 respectively show schematic partial structural diagrams of a first adjusting piece 30 and a second adjusting piece 30' in a branching air supply device 100 at different rotary positions according to embodiments of the present invention. Since the first adjusting piece 30 drives the second adjusting piece 30' to synchronously move in opposite directions, the state of each of the air outlets 212 in the first half portion 21 of the housing 20 is the same as the state of a corresponding air outlet 212 in the second half portion 21' of the housing 20, and taking the motion of the adjusting pieces in the first half portion 21 as an example, the open and closed states of the first air outlet 213, the second air outlet 214 and the third air outlet 215 of each of the first half portion 21 and the second half portion 21' are explained below. Specifically, when the first shield portion 311 and the second shield portion 312 of the first adjusting piece 30 rotate to positions as shown in FIG. 3, the first air outlet 213, the second air outlet 214 and the third air outlet 215 of each of the first half portion 21 and the second half portion 21' are all in the open state. When the first shield portion 311 and the second shield portion 312 of the first adjusting piece 30 rotate to positions as shown in FIG. 4, the second shield portion 312 completely shields the second air outlet 214 and the third air outlet 215, so that the first air outlet 213 may be in a completely exposed state. When the first shield portion 311 and the second shield portion 312 of the first adjusting piece 30 rotate to positions as shown in FIG. 5, the first shield portion 311 may completely shield the third air outlet 215, the second shield portion 312 may completely shield the first air outlet 213, and the spacing between the two shield portions 31 may cause the second air outlet 214 to be in a completely exposed state. When the first shield portion 311 and the second shield portion 312 of the first adjusting piece 30 rotate to positions as shown in FIG. 6, the second shield portion 312 may completely shield the first air outlet 213 and the second air outlet 214, and the spacing between the two shield portions 31 may cause the third air outlet 215 to be in a completely exposed state.

Figure 7:
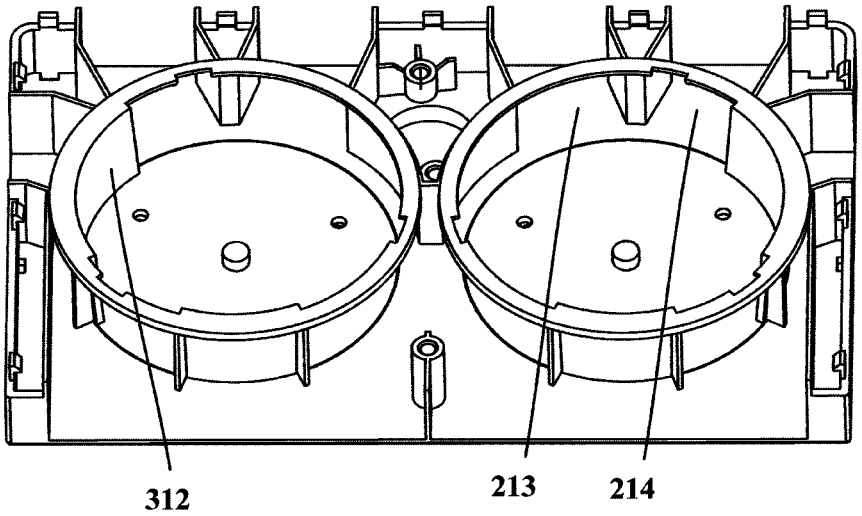
Figure 8:
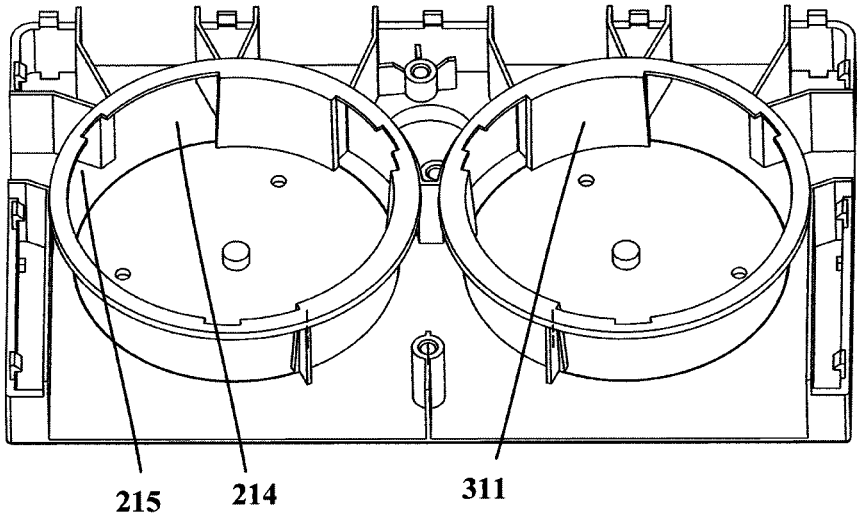
Figure 9:
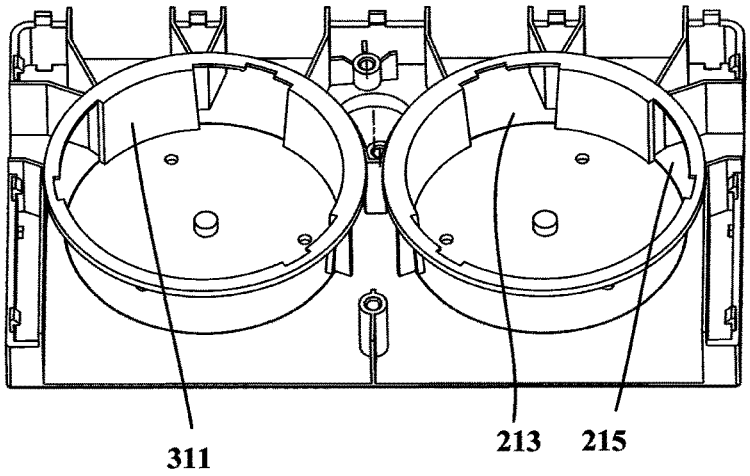

When the first shield portion 311 and the second shield portion 312 of the first adjusting piece 30 rotate to positions as shown in FIG. 7, the second shield portion 312 may only completely shield the third air outlet 215 and the first air outlet 213 and the second air outlet 214 are in a completely exposed state. When the first shield portion 311 and the second shield portion 312 of the first adjusting piece 30 rotate to positions as shown in FIG. 8, the first shield portion 311 may completely shield the first air outlet 213 and the second air outlet 214 and the third air outlet 215 are in a completely exposed state. When the first shield portion 311 and the second shield portion 312 of the first adjusting piece 30 rotate to positions as shown in FIG. 9, the first shield portion 311 may completely shield the second air outlet 214, the third air outlet 215 is in a completely exposed state and the spacing between the two shield portions 31 may cause the first air outlet 213 to be in a completely exposed state. Of course, the first shield portion 311 and the second shield portion 312 of the first adjusting piece 30 may also rotate to rotary positions where half of the first air outlet 213 is shielded and the second air outlet 214 and the third air outlet 215 are in a completely exposed state such as a position where the first shield portion 311 only shields half of the first air outlet 213 away from the second air outlet 214. The first shield portion 311 and the second shield portion 312 may also rotate to positions where the first air outlet 213 is completely shielded, half of the second air outlet 214 is shielded and the third air outlet 215 is in a completely exposed state such as positions where the second shield portion 312 completely shields the first air outlet 213 and shields half of the second air outlet 214 away from the third air outlet 215.

In some embodiments of the present invention, the housing 20 may further comprise one or more rib plates 23 and a distributor cover 24. Each of the rib plates 23 extends from one surface of the base 22. The distributor cover 24 may be arranged on one end of the one or more rib plates 23 away from the base 22. The base 22, the one or more rib plates 23 and the distributor cover 24 define an air-inlet passage 25, a plurality of first air-outlet passages 26 and a plurality of second air-outlet passages 26'. The air-inlet passage 25 may be communicated with each air inlet 211 and symmetrically arranged with respect to the geometric symmetrical plane. The plurality of first air-outlet passages 26 are respectively communicated with the plurality of air outlets 212 of the first half portion 21. The plurality of second air-outlet passages 26' are respectively communicated with the plurality of air outlets 212 of the second half portion 21' and the plurality of second air-outlet passages 26' and the plurality of first air-outlet passages 26 are symmetrically arranged with respect to the geometric symmetrical plane. Further, an accommodation space 27 for accommodating the motor 40 may also be defined between the base 22, the one or more rib plates 23 and the distributor cover 24 as well as two arcuate peripheral walls. The base 22 may be a square structure.

Figure 10:
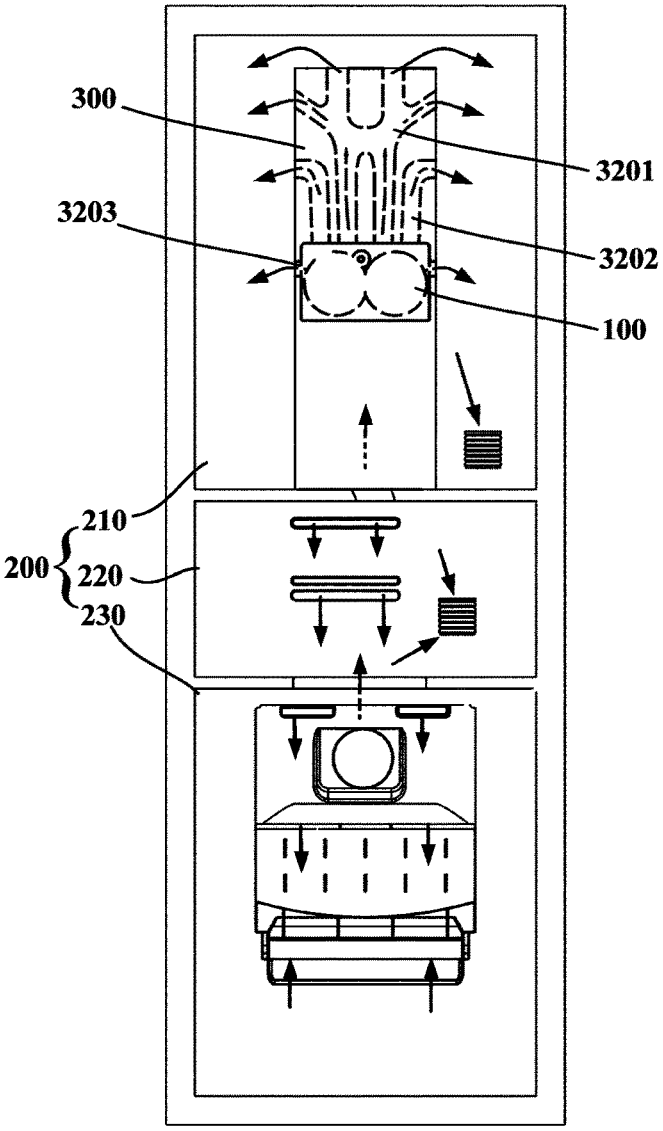
FIG. 10 is a schematic structural diagram of a refrigerator according to one embodiment of the present invention.
Figure 11:
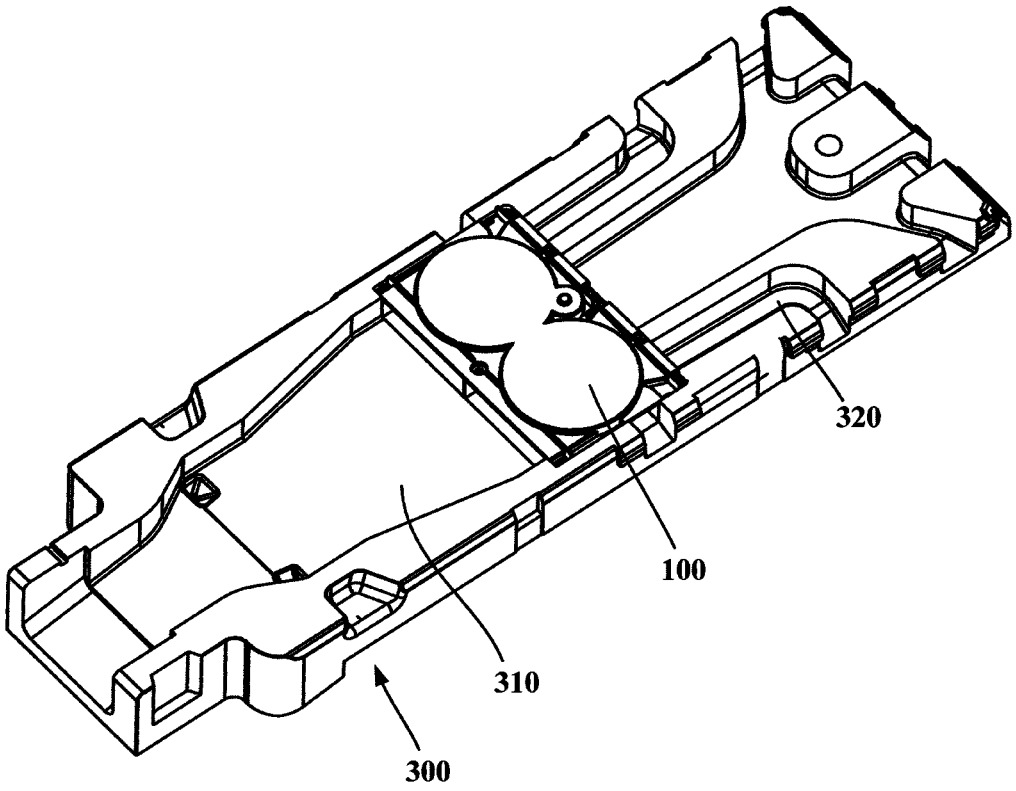
FIG. 11 is a schematic structural diagram of the branching air supply device being mounted to an air duct assembly according to one embodiment of the present invention.

FIG. 10 is a schematic structural diagram of the refrigerator according to one embodiment of the present invention, and FIG. 11 is a schematic structural diagram of the branching air supply device 100 being mounted to an air duct assembly 300 according to one embodiment of the present invention. As shown in FIG. 10 and FIG. 11, embodiments of the present invention further provide a refrigerator having a storage compartment 200, and the storage compartment 200 may also be divided into a plurality of storage spaces by plates or racks. Further, the refrigerator is also provided with the air duct assembly 300 and the branching air supply device 100 of any one of the above-mentioned embodiments arranged within the air duct assembly 300.

The air duct assembly 300 may be symmetrically arranged with respect to the longitudinal symmetrical plane of the storage compartment 200 of the refrigerator, an air-inlet duct 310 and a plurality of air-outlet ducts 320 are defined within the air duct assembly, and each of the air-outlet ducts 320 may be provided with one or more cold air outlets. The plurality of air-outlet ducts 320 are configured such that air flowing out of the air duct assembly 300 enters the storage compartment 200 from a plurality of positions being on compartment walls of the storage compartment 200 and being symmetric about the longitudinal symmetrical plane, respectively. For example, the air duct assembly 300 is provided with four first cold air outlets on one side of the longitudinal symmetrical plane and four second cold air outlets on the other side of the longitudinal symmetrical plane, and the four first cold air outlets and the four second cold air outlets are symmetrically arranged with respect to the longitudinal symmetrical plane, so that air flowing out of the air duct assembly 300 enters the storage compartment 200 from the plurality of positions being on the compartment walls of the storage compartment 200 and being symmetric about the longitudinal symmetrical plane, respectively.

The at least one air inlet 211 of each of the first half portion 21 and the second half portion 21' of the branching air supply device 100 is communicated with the air-inlet duct 310. The plurality of air outlets 212 of the first half portion 21 of the housing 20 of the branching air supply device 100 are respectively communicated with a plurality of air-outlet ducts 320 on one side of the longitudinal symmetrical plane. The plurality of air outlets 212 of the second half portion 21' of the housing 20 are respectively communicated with a plurality of air-outlet ducts 320 on the other side of the longitudinal symmetrical plane.

As shown in FIG. 11, in some embodiments of the present invention, two air-outlet ducts 320 adjacent to the longitudinal symmetrical plane are communicated with each other, forming an air-outlet duct space symmetric about the longitudinal symmetrical plane. Preferably, the two air-outlet ducts 320 adjacent to the longitudinal symmetrical plane may be designed to be a first entire air duct, which may facilitate processing of the air duct assembly 300.

Specifically, as shown in FIG. 10 and FIG. 11, the refrigerator may comprise a plurality of storage compartments 200, and the air duct assembly 300 is used for transporting air to a refrigerating chamber 210. In FIG. 10, the solid arrows represent flow directions of air within one or more storage compartments 200 and the dotted arrows represent flow directions of air within the ducts. Each of the first half portion 21 and the second half portion 21' of the housing 20 in the branching air supply device 100 is provided with three air outlets 212, such as the first air outlet 213, the second air outlet 214 and the third air outlet 215. There may be six air-outlet ducts 320, such as two first air ducts 3201 respectively communicated with two first air outlets 213, two second air ducts 3202 respectively communicated with two second air outlets 214, and two third air ducts 3203 respectively communicated with two third air outlets 215. The two first air ducts 3201 are arranged adjacent to the longitudinal symmetrical plane and may be communicated with each other, as shown in FIG. 10; and there may be no partition plate arranged between the two first air ducts 3201, so that the two first air ducts 3201 form an entire air duct, as shown in FIG. 11. Each of the first air ducts 3201 may be provided with two cold air outlets arranged at an upper portion of a rear wall of the refrigerating chamber 210. Each of the second air ducts 3202 may be provided with one cold air outlet arranged at an intermediate portion of the rear wall of the refrigerating chamber 210. Each of the third air ducts 3203 may be provided with one cold air outlet arranged at a lower portion of the rear wall of the refrigerating chamber 210. Further, the refrigerating chamber 210 may also be divided into three storage spaces using two racks, each of the first air ducts 3201 may be communicated with the upper storage space, each of the second air ducts 3202 may be communicated with the intermediate storage space and each of the third air ducts 3203 may be communicated with the lower storage space. In the embodiment, the plurality of storage compartments 200 may further comprise a quick-freezing chamber 220 and a freezing chamber 230.

The refrigerator in the embodiments of the present invention may control, according to whether the refrigerating capacity at positions of each layer of the refrigerator storage compartment 200 (such as the refrigerating chamber 210) is sufficient, cold air to flow into the positions of the layer from a corresponding air-outlet duct 320, so that the cold air is reasonably distributed to different positions of the storage compartment 200, which increase the freshness preservation performance and running efficiency of the refrigerator. The branching air supply device 100 can implement the adjustment of the air directions and air amount of the air-outlet ducts 320, so that if a layer within the storage compartment 200 of the refrigerator needs cold air, the cold air outlet of the layer is opened, and the cold air outlet is closed when there is no need for cold air. Thus, the constancy of the temperature within the refrigerator is controlled, optimal storage environment is provided for food within the refrigerator, nutrition loss of food is reduced, power consumption of the refrigerator is reduced, and energy is saved. In addition, each layer is provided with at least two cold air outlets that are symmetrically arranged with respect to the longitudinal symmetrical plane of the storage compartment 200, so that left and right sides of the layer of the refrigerator storage compartment 200 are refrigerated uniformly.

To this end, it is recognized by a person skilled in the art that although multiple exemplary embodiments of the present invention have been shown and described in detail herein, many other variations or modifications complying with the principles of the present invention can be directly determined or derived from the contents disclosed in the present invention without departing from the spirit and scope of the present invention. Therefore, the scope of the present invention should be construed and deemed as encompassing all these and other variations or modifications.

What is claimed is:

1. A branching air supply device for a refrigerator, comprising:

a housing having a first half portion and a second half portion that are symmetric about a geometric symmetrical plane, the first half portion and the second half portion each being provided with at least one air inlet and a plurality of air outlets; and a first adjusting piece and a second adjusting piece symmetrically arranged with respect to the geometric symmetrical plane that are respectively configured to completely shield, partially shield or completely expose each of the air outlets of the first half portion and the second half portion in a controlled mode so as to adjust an air-outlet area of each of the air outlets, wherein the first adjusting piece and the second adjusting piece synchronously move in opposite directions to completely shield, partially shield or completely expose the plurality of air outlets of the first half portion and the second half portion in a synchronous and symmetrical manner.

2. The branching air supply device according to claim 1, wherein the housing comprises a base;

the first half portion and the second half portion each comprise an arcuate peripheral wall extending from one surface of the base, and the plurality of air outlets are formed on the arcuate peripheral wall of each of the first half portion and the second half portion respectively;

the first adjusting piece and the second adjusting piece each comprise one or more shield portions spaced along a circumferential direction of the respective arcuate peripheral wall, and at least part of each of the shield portions of the first half portion and the second half portion oriented towards a surface of the respective arcuate peripheral wall is coaxially arranged with the arcuate peripheral wall, and the first adjusting piece and the second adjusting piece are rotatably mounted to the housing about an axis of the respective arcuate peripheral wall, so that the one or more shield portions of each of the first adjusting piece and the second adjusting piece completely shield, partially shield or completely expose each of the respective air outlets when being moved to a different position.

3. The branching air supply device according to claim 2, wherein the at least one air inlet of each of the first half portion and the second half portion is one air inlet, and two ends of the arcuate peripheral wall of each of the first half portion and the second half portion along the respective circumferential direction define the respective air inlet; or the first half portion and the second half portion each further comprise another arcuate peripheral wall extending from the one surface of the base, constituting a cylindrical structure with the arcuate peripheral wall, and the at least one air inlet is formed on the other arcuate peripheral wall of each of the first half portion and the second half portion respectively.

4. The branching air supply device according to claim 2, wherein the first adjusting piece and the second adjusting piece each further comprise a rotary table portion, and each of the shield portions of the first half portion and the second half portion extends from one surface of the respective rotary table portion respectively.

5. The branching air supply device according to claim 4, wherein the rotary table portions of the first adjusting piece and the second adjusting piece are rotatably mounted to an end face of the respective arcuate peripheral wall away from one end of the base.

6. The branching air supply device according to claim 4, wherein each of the shield portions of the first adjusting piece and the second adjusting piece is respectively located on a radial inner side of the respective arcuate peripheral wall.

7. The branching air supply device according to claim 4, further comprising:

a motor arranged on a radial outer side of the rotary table portion of the first adjusting piece and/or the second adjusting piece; and a transmission mechanism configured to transfer the rotary motion output by the motor to the first adjusting piece and the second adjusting piece in a decelerating manner.

8. The branching air supply device according to claim 7, wherein the transmission mechanism comprises:

a first gear mounted to an output shaft of the motor; and two second gears engaged with each other that are coaxially fixed to another surface of the rotary table portions of the first adjusting piece and the second adjusting pieces respectively with the rotary table portions of the first adjusting piece and the second adjusting pieces, one of the second gears being engaged with the first gear.

9. The branching air supply device according to claim 2, wherein the housing further comprises:

one or more rib plates extending from the one surface of the base;

a distributor cover arranged on one end of the one or more rib plates away from the base; and the base, the one or more rib plates and the distributor cover define:

an air-inlet passage communicated with each of the air inlets and symmetrically arranged with respect to the geometric symmetrical plane;

a plurality of first air-outlet passages respectively communicated with the plurality of air outlets of the first half portion; and a plurality of second air-outlet passages respectively communicated with the plurality of air outlets of the second half portion, the plurality of second air-outlet passages and the plurality of first air-outlet passages being symmetrically arranged with respect to the geometric symmetrical plane.

10. A refrigerator having a storage compartment, the refrigerator further comprising:

an air duct assembly which is symmetrically arranged with respect to a longitudinal symmetrical plane of the storage compartment and within which an air-inlet duct and a plurality of air-outlet ducts are defined, wherein each of the air-outlet ducts is provided with one or more cold air outlets, and the plurality of air-outlet ducts are configured such that air flowing out of the air duct assembly enters the storage compartment from a plurality of positions being on compartment walls of the storage compartment and being symmetric about the longitudinal symmetrical plane, respectively; and the branching air supply device according to claim 1 arranged within the air duct assembly, at least one air inlet of each of the first half portion and the second half portion of the branching air supply device being communicated with the air inlet duct, the plurality of air outlets of the first half portion being respectively communicated with a plurality of the air-outlet ducts located on one side of the longitudinal symmetrical plane, and the plurality of the second half portion being respectively communicated with a plurality of the air-outlet ducts located on the other side of the longitudinal symmetrical plane.

11. The refrigerator according to claim 10, wherein two of the air-outlet ducts adjacent to the longitudinal symmetrical plane are communicated with each other, forming an air-outlet duct space symmetric about the longitudinal symmetrical plane.

* * * * *